United States Patent [19]

Loder

[11] Patent Number: 4,586,629

[45] Date of Patent: May 6, 1986

[54] NOTEPAPER DISPENSER PACKAGE

[75] Inventor: Harry A. Loder, Mahtomedi

[73] Assignee: Minnesota Mining and Manufacturing Company, St. Paul, Minn.

[21] Appl. No.: 693,147

[22] Filed: Jan. 22, 1985

Related U.S. Application Data

[63] Continuation-in-part of Ser. No. 595,236, Apr. 2, 1984.

[51] Int. Cl.[4] ..... B65H 1/04

[52] U.S. Cl. ..... 221/46; 221/305

[58] Field of Search ..... 221/26, 33, 44–63, 221/305; 225/106; 312/50, 60, 61

[56] References Cited

U.S. PATENT DOCUMENTS

| | | | |
|---|---|---|---|
| 2,849,152 | 8/1958 | Tuttle | 221/48 |
| 3,970,215 | 7/1976 | McLaren et al. | 221/45 |
| 4,416,392 | 11/1983 | Smith | 221/45 |

FOREIGN PATENT DOCUMENTS

| | | | |
|---|---|---|---|
| 793745 | 4/1958 | United Kingdom | 221/63 |

*Primary Examiner*—F. J. Bartuska

*Attorney, Agent, or Firm*—Donald M. Sell; James A. Smith; John C. Barnes

[57] ABSTRACT

A convenient dispensing package for a stack of adhesive-coated notepaper comprises a box for containing a stack of sheets with a removable central portion on one end of the box and a band is wrapped about four sides of the stack of sheets with the ends of the band having interfering end portions defining the dispensing opening positioned centrally of the removable box portion.

8 Claims, 3 Drawing Figures

NOTEPAPER DISPENSER PACKAGE

CROSS-REFERENCES TO RELATED APPLICATIONS

This application is a continuation-in-part of copending application Ser. No. 595,236, filed Apr. 2, 1984, for Dispensing Package For Sheets.

BACKGROUND OF THE INVENTION

1. Field of the Invention

This invention relates to an improved primary package for notepaper to form a sales package which is converted to a dispenser for the notepaper, and in one aspect, to a two-part package for a stack of notepaper which is easily filled and sealed.

2. Description of the Prior Art

This application is directed to an improvement in a package for holding and dispensing sheets of notepaper.

An earlier U.S. Pat. No. 4,416,392, issued Nov. 22, 1983 and assigned to the assignee of this application, teaches the use of a package for dispensing sheet material wherein the sheet material is coated along one edge of each sheet with a pressure-sensitive adhesive, and the stack of sheets are formed by each sheet being adhered to the next adjacent sheet along alternately opposite edges to form the stack. As one sheet is withdrawn from the package, the adhesive coated edge of the sheet being withdrawn pulls the free edge of the next adjacent sheet and withdraws the same through the opening in the package. The patented dispenser was improved upon in copending applications Ser. Nos. 595,235 and 595,236, filed Apr. 2, 1984 and assigned to the assignee of this application. The copending applications disclosed packages from which the sheet material could be readily dispensed and the packages were so designed with a dispensing opening such that as one sheet was withdrawn from the package the free end of the next successive sheet was withdrawn through the dispensing opening, but the edges of the package defining the dispensing opening would close upon the next sheet and frictionally hold the sheet in a position with one edge extending from the opening to be easily grasped and subsequently dispensed. This package design permitted the package to contain a stack of sheet material of greater height and yet afford the dispensing of the individual sheets from the stack until the last of the sheets were dispensed.

The package of the present invention provides a package having the same dispensing features of the prior package and one which is easily loaded with a stack of sheets mechanically.

The package of the present invention also provides an improved sheet dispensing package in that sheet material is enclosed for point of sale display but has a partially perforated panel which is removable to expose the dispensing opening of the package for use.

SUMMARY OF THE INVENTION

The present invention comprises a package for holding and dispensing sheets of notepaper which are arranged in a stack with each sheet in the stack adhered adhesively to the adjacent sheet by a narrow band of readily releasable repositionable normally tacky adhesive coated along one edge thereof. The sheets are coated with the adhesive along alternately opposite edges of successive sheets. The package comprises a box blank which defines a sleeve or band which is wrapped about four sides of the stack, with the ends of the blank overlapping and defining a dispensing opening which is positioned generally centrally of the stack of notepaper and extending transversely between the adhesive coated edges of the successive sheets. The band and stack of sheets are positioned within a rectangular box or cube. The box encloses the stack of sheets and the band and has a cover extending over the ends of the band and the top of the stack of sheets. The cover is perforated at spaced parallel positions with one perforation positioned in spaced relation on opposite sides of said dispensing opening to permit removal of a portion of said cover extending over the ends of the band forming the dispensing opening. The portion of the cover between the perforations may be removed along its ends and along the perforations to expose the dispensing opening of the package.

The ends of the box blank forming the band have mating edges to frictionally grasp the sheets therebetween as they are drawn from the package. The edges of the cover adjacent the perforations define fulcrum points for urging the end flap portions of the box blank from the inclined dispensing position back into a generally planar sheet contacting relationship.

The blank forming the band is also provided with scored fold lines adjacent the ends to permit some degree of flexure of the end portions thereof defining the dispensing opening. The ends of the band defining the dispensing opening are preferably scalloped and the band has a length greater than the circumference of the stack. The ends may be parallel and overlapping.

BRIEF DESCRIPTION OF THE DRAWINGS

The invention will be described in greater detail hereinafter with reference to the accompanying drawing wherein.

DESCRIPTION OF THE PREFERRED EMBODIMENTS

Figure 1:
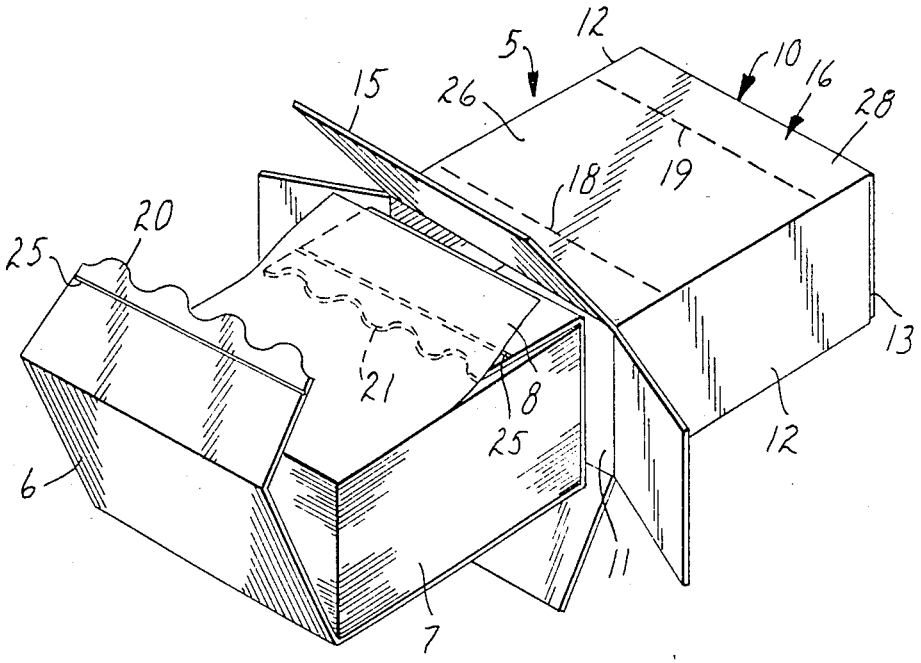
FIG. 1 is a perspective view of the package of the present invention illustrating the assembly of the package.
Figure 2:
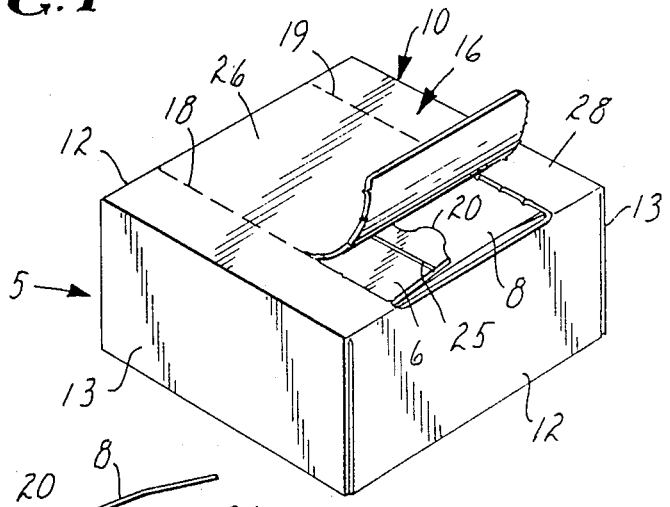
FIG. 2 is a perspective view of the package illustrating the same in a partially opened positioned.

The package of the present invention, generally designated by the reference numeral 5 comprises a box blank defining a sleeve or band 6 which is folded at four fold lines and surrounds four sides of a stack 7 of sheets 8 of notepaper. The band 6 has a length greater than the circumference of the side view of the stack. The band 6 and stack 7 are placed in a box 10.

Figure 3:
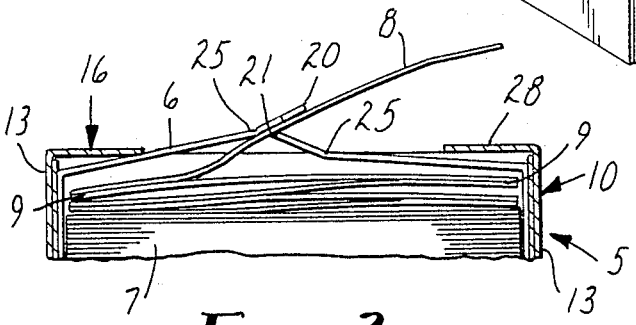
FIG. 3 is a fragmentary vertical sectional view of the package opened with some of the sheets dispensed therefrom.

Each sheet 8 of notepaper has a coating of readily releasable repositionable normally tacky adhesive positioned along an edge, as illustrated by the reference numeral 9 in FIG. 3, with the band of adhesive preferably on the lower side adjacent one edge of each sheet. The adhesive adheres each sheet to the next adjacent sheet along alternately opposite edges of successive sheets such that dispensing the adhesive free edge of one sheet will draw the adhesive free edge of the next adjacent sheet from the package by the adhesive bond between the first sheet and the successive sheet. The dispensed sheet may then be readily peeled from the adhesive free end of the successive sheet as the peel force is less than the shear force, affording sheet separation without withdrawing a third sheet.

The band 6 and stack 7 are placed in the rectangular box 10 having a base 11, opposite side walls 12, and end walls 13 formed by folding two or more flaps over the open end of the box and adhering the outermost flap 15 to the adjacent flap to seal the ends. A cover 16 forms the sixth side of the package. The cover 16 extends over the the top of the stack 7 of sheets 8 and encloses the package. As described, the package 5 is the point of sale or primary package. A transparent overwrap could cover the package. The cover 16 is provided with parallel spaced lines of perforations 18 and 19 which extend from one side wall 12 to the other side wall 12 at spaced positions and spaced from the ends of the band 6.

The band 6 is formed of a sheet of box board having fold lines to permit the same to be folded about the stack 7. The ends of the band overlap or interfer with each other and are preferably formed with scalloped or undulated ends which mate to define a dispensing opening with the undulations acting to increase the frictional force on the sheets as they are withdrawn through the opening between the two edges. The sheet 6 forming the band is also provided with additional score lines 25 extending transversely of the sheet and adjacent the edges 20 and 21. The score lines 25 permit the extended overlapping ends of the sleeve to flex at the score line and assume an inclined position during dispensing.

The area 26 of the cover 16 between the line of perforations 18 and the line of perforations 19 can be removed. The ends of the area 20 may be severed from the edge walls 12 or formed with perforations at the intersection of the side walls 12 and the area 26 of the cover 16 to permit the same to be lifted and torn along the perforations 18 and 19 to remove the same from the cover. Removal of the area 26 exposes the dispensing opening defined between the edges 20 and 21 of the band 6 and exposes the free end of the uppermost sheet 8 in the package. The free end of the sheet 8 may be withdrawn from under the remaining area 28 of the cover 16 to a position as shown in FIG. 3.

The free end of the sheet 8 may then be readily grasped and drawn through the dispensing opening between the edges 20 and 21. The narrow band of adhesive material 9 pulls the free end of the next successive sheet upwardly through the opening and then the first sheet 8 may be peeled from the free end of the successive sheet and separated for placement on a receptor surface. A message may then be written onto the sheet 8. Alternatively, the free edge of the sheet 8 may have the band of adhesive exposed if the stack of sheet material is inverted with the adhesive coated side exposed. This would permit the package to be inverted, the adhesive to be applied to a receptor surface and lifting the package dispenses the applied sheet and withdraws the free adhesive coated edge of the next sheet.

The dispensing opening is defined by an undulated edge on the flap portions of the band 6, i.e., a saw-toothed edge, sine wave shaped, square wave shaped edge or the like, such that with a sheet disposed in the opening between the ends, the overlapping ends of the band hold the sheet tightly therebetween to hold the edge of the sheet raised and to prevent the sheet from falling back into the dispenser onto the stack of sheets.

A specific example of the package is a box enclosing a stack of 300 sheets of 20 pound bond paper 2.94 inches (7.46 cm) by 3.06 inches (7.78 cm). The box is formed of 20 point box board and has outside dimensions of 3.18×3.125×1.69 inches (8.096×7.94×4.29 cm). The position of the perforated lines 18 and 19 is 0.375 inch (0.1 cm) from the edge of the box. The band is formed of 20 point box board and the height or interference of the undulations at the ends of the sleeve are 0.187 to 0.5 inch (4.76 to 12.7 mm). An example of the adhesive material is a pressure sensitive repositionable acrylate copolymer adhesive, as described in U.S. Pat. No. 3,691,140, assigned to the assignee of this application, coated on a strip adjacent the edge of each sheet 0.25 inch (6 mm) to 0.75 inch (19 mm) wide. The width of the band of adhesive material would not exceed one half the dimension of a sheet measured from the edge.

Suitable graphics and designs or logos may be printed on the package 5 to make it attractive and to serve as an advertising medium.

Having thus described the present invention, what is claimed is:

1. A package for dispensing sheets of notepaper which are arranged in the stack and adhered to each other by a narrow band of pressure-sensitive adhesive material positioned at opposite edges of successive sheets within the stack, said package comprising a box blank consisting essentially of box board having fold lines defining a band which is wrapped about four sides of the stack of sheets to define flexible flap portions having terminal overlapping ends defining a dispensing opening positioned generally centrally of the stack of sheets parallel to and between said opposite edges, and a box-like structure comprising a base, sidewalls and a cover supporting said band and a stack of said sheets therein, said cover having means for defining an opening extending between opposed sidewalls of said structure and between said opposite edges for exposing said flap portions and the terminal ends of said band.

2. A package according to claim 1 wherein said terminal ends of the band have score lines adjacent said terminal ends to afford increased flexure of the flaps adjacent said terminal ends of the band.

3. A package according to claim 1 wherein the ends are formed with undulations which mate with each other.

4. A package according to claim 2 wherein the ends are formed with undulations which mate with each other.

5. A package according to claim 1 wherein said cover extends over the ends of said band and the stack of sheets and said means for defining an opening in said cover is a removable cover portion separated along spaced perforations to expose said dispensing opening.

6. A package according to claim 1 wherein said cover extends over the ends of said band and the stack of sheets and said cover is perforated at spaced positions with one perforation in spaced relation opposite and generally parallel to each of said ends to permit removal of a portion of said cover between said perforations to define said means defining an opening.

7. A package according to claim 6 wherein said band is formed with fold lines adjacent ends of said band to permit the said ends to flex during dispensing.

8. A package according to claim 1 wherein said stack of sheets is positioned with the adhesive coated surface of the sheets positioned adjacent the dispensing opening such that the adhesive coated edge of the top sheet extends from the dispensing opening and as it is withdrawn the opposite edge withdraws the adhesive coated end of the next sheet through the dispensing opening.

* * * * *